US006733307B2

(12) United States Patent
Wu

(10) Patent No.: US 6,733,307 B2
(45) Date of Patent: May 11, 2004

(54) ELECTRICAL CONNECTOR WITH SECURELY RETAINED TERMINALS

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/211,194

(22) Filed: Aug. 1, 2002

(65) Prior Publication Data

US 2004/0023531 A1 Feb. 5, 2004

(51) Int. Cl.[7] ..... H01R 12/00
(52) U.S. Cl. ..... 439/79
(58) Field of Search ..... 439/79, 62, 80, 439/83, 51

(56) References Cited

U.S. PATENT DOCUMENTS 5,504,994 A * 4/1996 Banakis et al. ..... 29/884
5,630,730 A 5/1997 Wang et al.
5,971,775 A * 10/1999 Tor et al. ..... 439/79
6,210,177 B1 4/2001 Huang et al.

OTHER PUBLICATIONS

SCA–2 Connector product specification.

* cited by examiner

*Primary Examiner*—Ross Gushi
(74) *Attorney, Agent, or Firm*—Wei Te Chung

(57) ABSTRACT

An electrical connector (1) includes an insulative housing (2) and a plurality of terminals (3, 4) received in the insulative housing. The insulative housing defines a number of receiving passageways (203) and a number of staggered recesses (213). Each terminal includes a first mounting portion (30, 40) received in corresponding recess, a second mounting portion (32, 42) received in corresponding receiving passageway and a slanted connecting portion (31, 41) connecting with the first and second mounting portion. A slanted surface (214) is provided on a rear end of the recess for abutting against the connecting portion.

10 Claims, 9 Drawing Sheets

ELECTRICAL CONNECTOR WITH SECURELY RETAINED TERMINALS

BACKGROUND OF THE INVENTION

1. Field of the Invention

The present invention relates to an electrical connector, and particularly to an electrical connector with terminals securely retained in an insulative housing of the electrical connector.

2. Description of Prior Art

As it is known that Single Connector Attachment (SCA) connectors provide a standard interface between Small Computer System Interface (SCSI) disk drives, Fiber Slot disk drives, Gigabit Interface Converter (GBIC) modules and back-plane systems. SCA-2 connectors, improvement of SCA, conform to the Small Form Factor (SFF) standard established by the Small Form Factor Committee. The detailed standard introduction of SCA-2, which is introduced by the web: http://www.methode.com.sg/mefewebhtm/MEFEwebPDF/sca2.pdf, will not be described hereafter.

U.S. Pat. Nos. 5,356,300 and 5,547,385 each disclose a pair of mating SCA-2 plug and receptacle connectors. The SCA-2 plug connector comprises an insulative housing and a plurality of terminals received in the insulative housing. The insulative housing defines two rows of rectangular passageways for retaining the terminals therein. However, the insulative housing has no securing means for securely retaining the terminals in the rectangular passageways.

U.S. Pat. Nos. 6,210,177, 5,269,694 and 5,630,730 disclose an approach in which the insulative housing includes a plurality of T-shaped slots for securely retaining terminals therein. However, the T-shaped slots are arranged in a row, which will reduce the thickness of the housing available between two adjacent slots, whereby the terminals cannot have a sufficient engagement with the housing. Thus, the terminals cannot be securely retained in the housing.

Hence, an improved electrical connector is required to overcome the disadvantages of the conventional electrical connector.

SUMMARY OF THE INVENTION

Accordingly, an object of the present invention is to provide an electrical connector with terminals securely retained in an insulative housing of the electrical connector.

Another object of the present invention is to provide an electrical connector with staggered T-shaped terminal receiving recesses so as to increase a thickness of the housing between two neighboring recesses, thereby reducing the possibility of breakage of the insulative housing due to an engagement of a terminal in a corresponding terminal receiving recess.

In order to achieve the objects above-mentioned, an electrical connector of the present invention includes an insulative housing and a plurality of terminals received in the insulative housing. The insulative housing includes a mating surface for mating with a plug connector, a mounting surface perpendicular to the mating surface for mounting on the PCB, a plurality of recesses at a rear end thereof and a slant surface formed in a rear end of each of the recesses. Each of the terminals comprises a first mounting portion received in corresponding recess, and a first connecting portion extending from a front end of the first mounting portion and abutting against a corresponding slant surface for securely retaining the terminal in the recess. The recesses are arranged in a staggered manner so as to increase a thickness of the housing between two neighboring recesses.

Other objects, advantages and novel features of the invention will become more apparent from the following detailed description when taken in conjunction with the accompanying drawings.

DETAILED DESCRIPTION OF THE INVENTION

Figure 1:
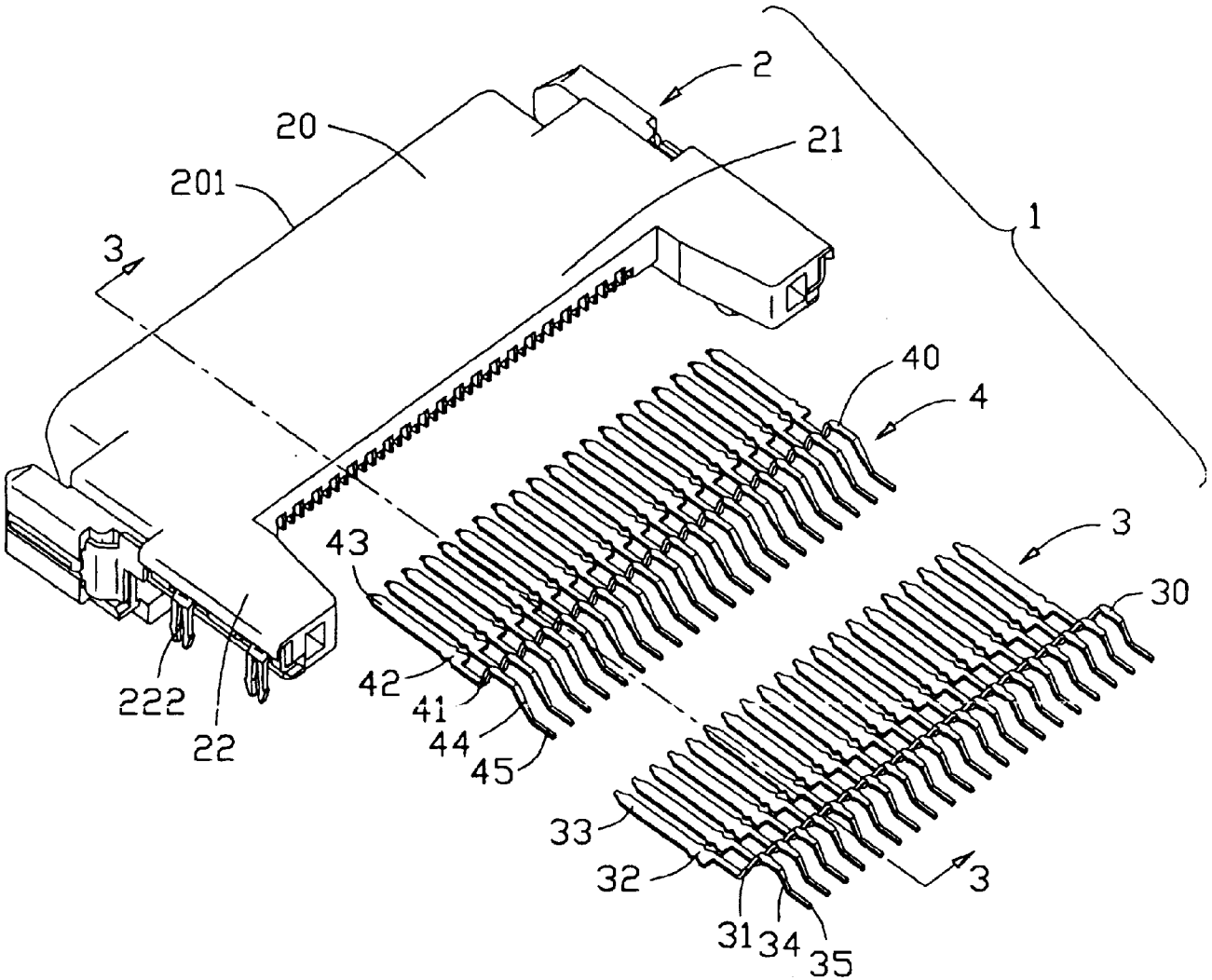
FIG. 1 is an exploded, perspective view of an electrical connector in accordance with the present invention.

Reference will now be made to the drawing figures to describe the present invention in detail.

Figure 2:
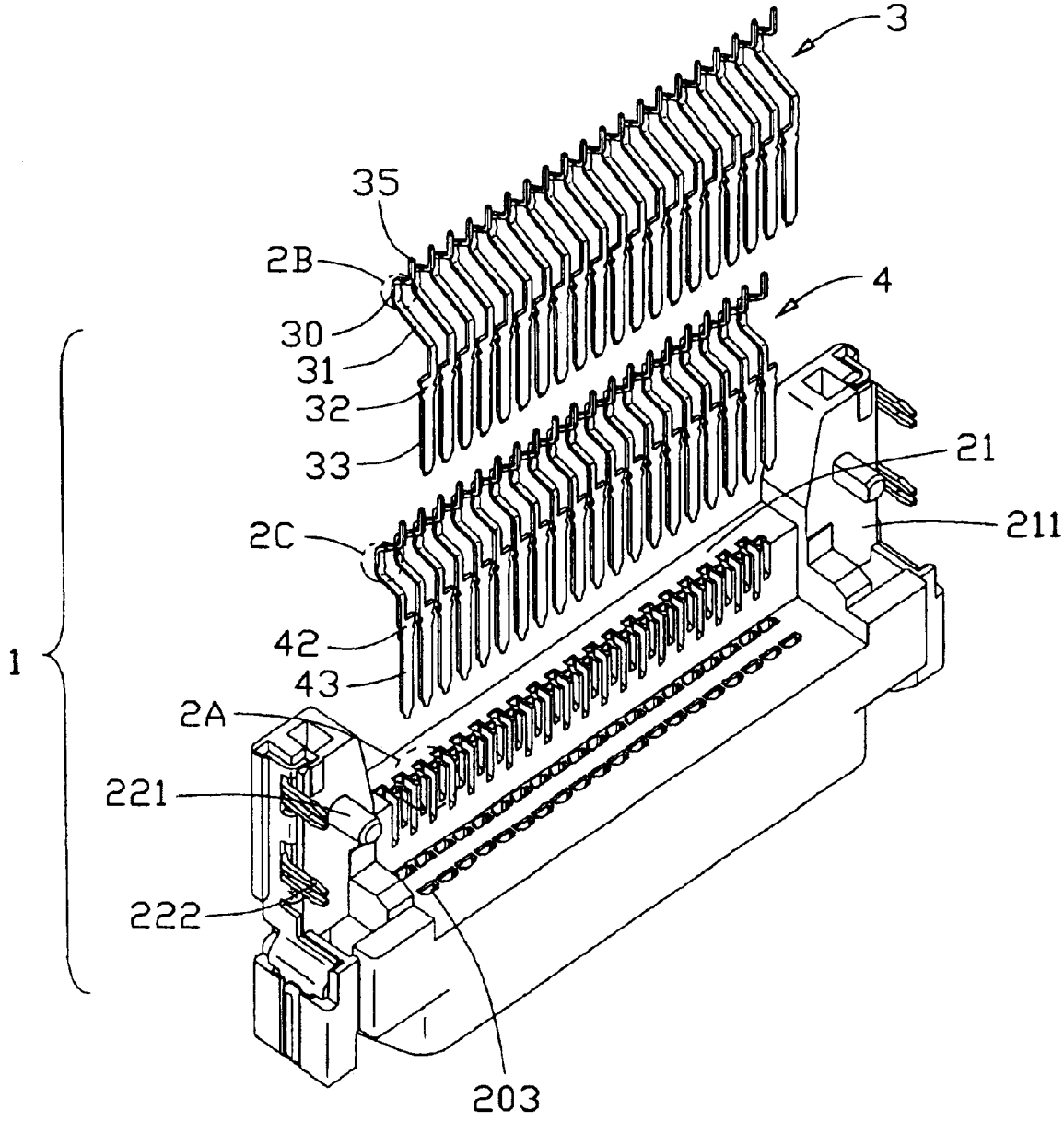
FIG. 2 is a view similar to FIG. 1, from a different aspect.
Figure 2A:
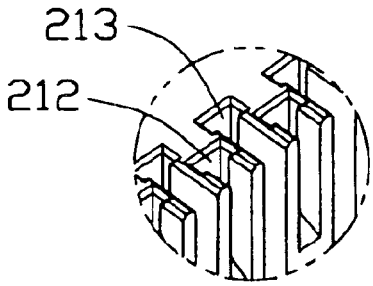
FIG. 2A is an enlarged view of a circled portion 2A of FIG. 2.
Figure 2B:
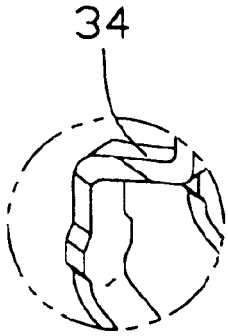
FIG. 2B is an enlarged view of another circled portion 2B of FIG. 2.
Figure 2C:
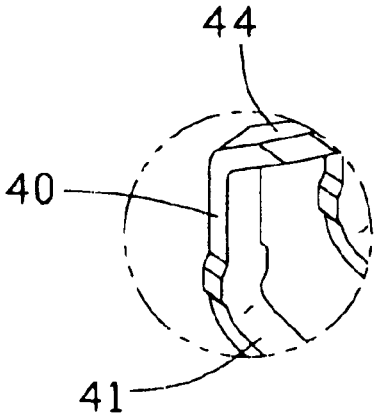
FIG. 2C is an enlarged view of a further circled portion 2C of FIG. 2.

Referring to FIGS. 1–2, an SCA-2 electrical connector 1 of the present invention comprises an insulative housing 2 and a plurality of first and second terminals 3, 4 received in the insulative housing 2.

The insulative housing 2 comprises an elongate main body 20, a rear portion 21 extending rearwardly from a rear end of the main body 20 and a pair of arms 22 extending rearwardly from respective opposite ends of the rear portion 21. The rear portion 21 is thinner than the main body 20. The main body 20 comprises a mating surface 201 for engaging with a mating electrical connector (not shown), a transverse receiving slot 202 defined in the mating surface 201 for receiving the mating electrical connector and a plurality of receiving passageways 203 arranged in two rows in communication with the receiving slot 202. The arms 22 comprise a bottom mounting surface 211 for mounting on a printed circuit board (PCB) 6 (referring to FIGS. 6 and 7) and a plurality of first and second T-shaped recesses 212, 213 alternately arranged in a transverse line. The first recesses 212 and the second recesses 213 are arranged in a staggered manner. The second T-shaped recesses 213 are longer than the first T-shaped recesses 212 and located thereabove. In addition, a slanted surface 214 is provided on a rear end of each of the first and second recesses 212, 213. Each of the arms 22 comprises a post 221 extending downwardly from the rear portion 21 for engaging with a through hole of the PCB 6. In addition, a pair of board locks 222 is assembled to each arm 22. With the assistance of the posts 221 and the board locks 222, the electrical connector 1 can be securely retained to the PCB 6.

Figure 3:
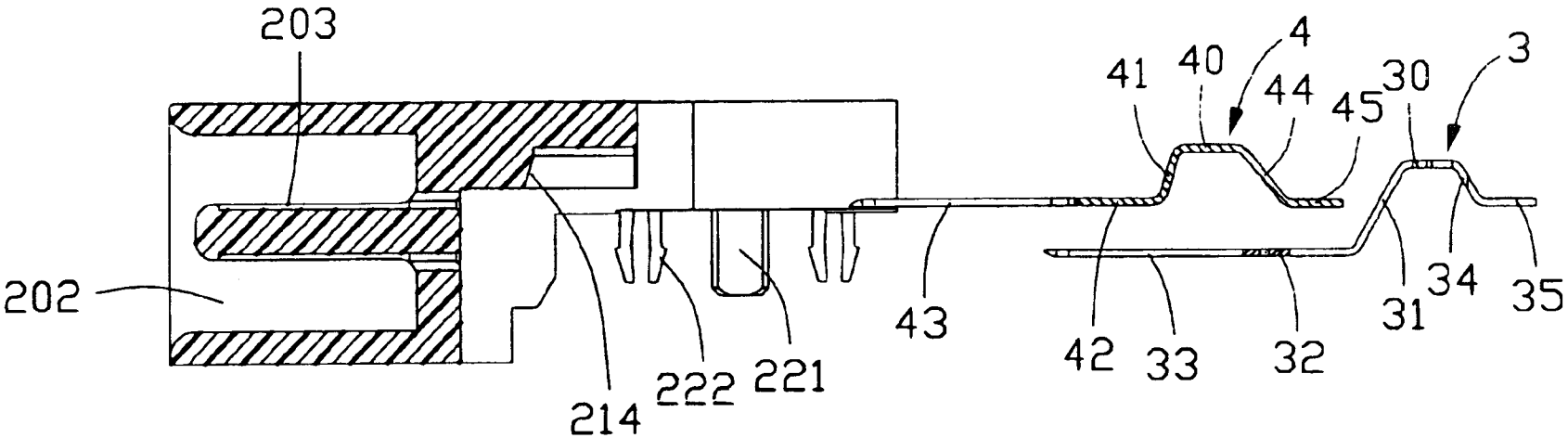
FIG. 3 is a cross-sectional view taken along line 3—3 of FIG. 1.
Figure 4:
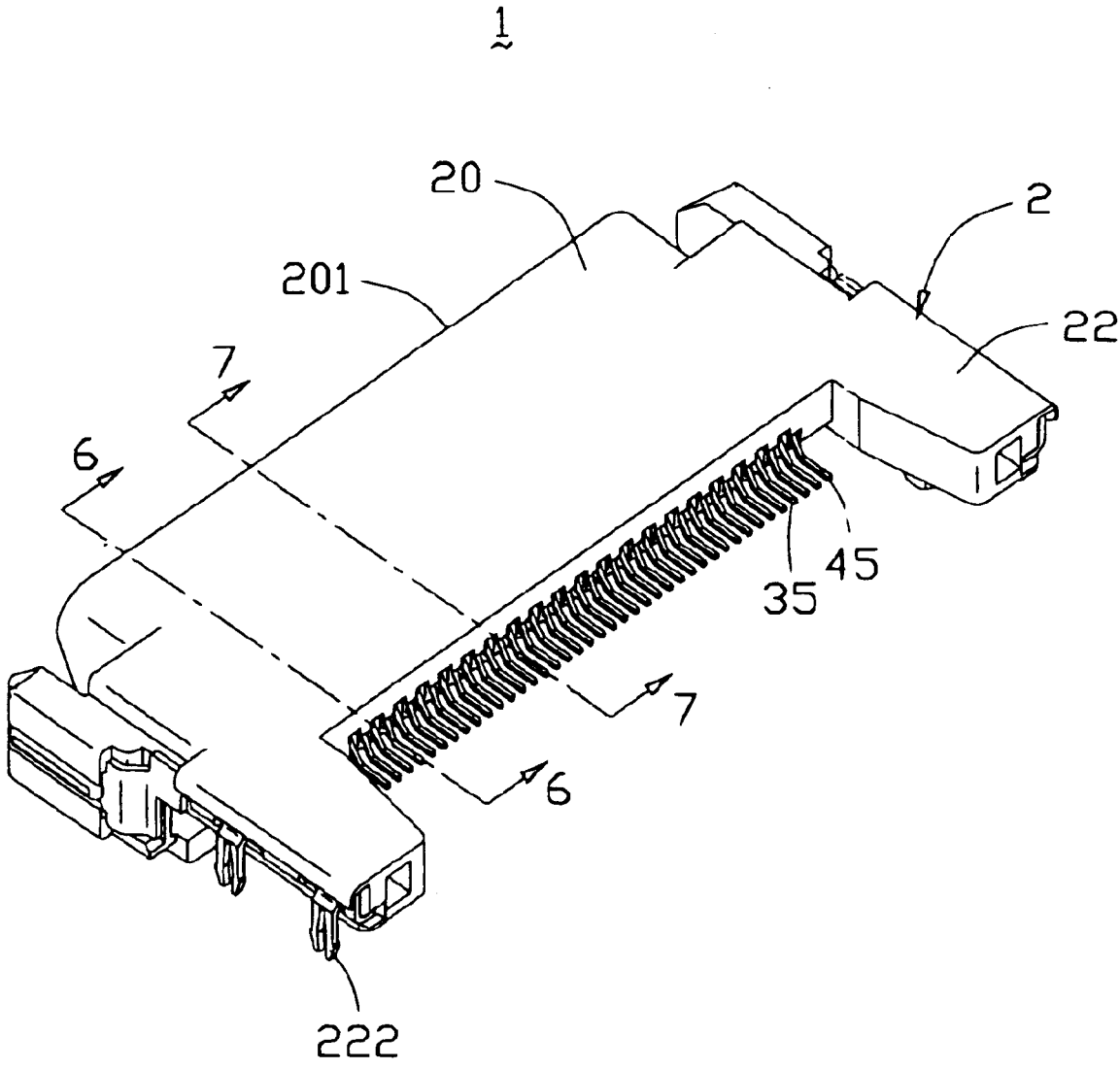
FIG. 4 is an assembled, perspective view of the electrical connector shown in FIG. 1.
Figure 5:
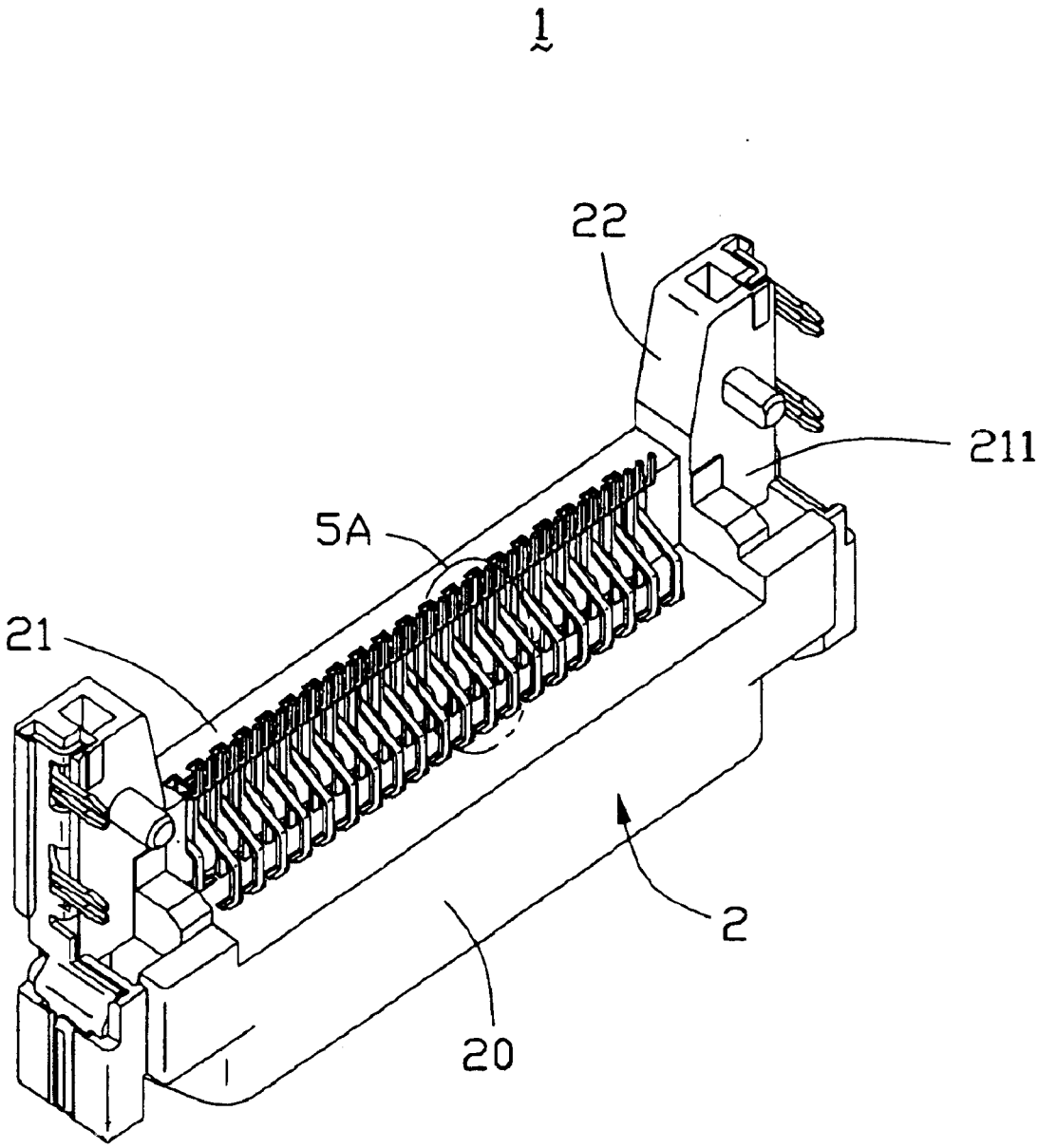
FIG. 5 is an assembled, perspective view of the electrical connector shown in FIG. 2.
Figure 5A:
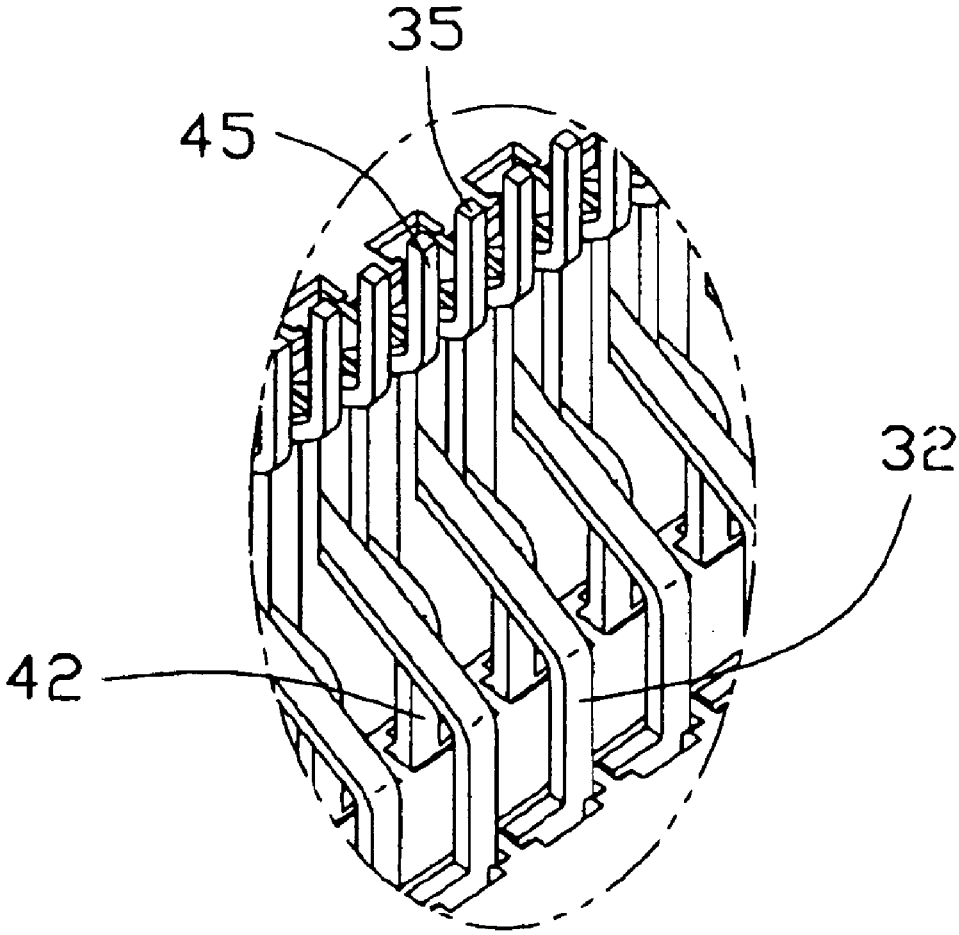
FIG. 5A is an enlarged view of a circled portion 5A of FIG. 5.

Referring to FIGS. 2–3, each of the first and second terminals 3 (4) comprises a first mounting portion 30 (40), a first connecting portion 31 (41) slantingly extending from a front end of the first mounting portion 30 (40), a second mounting portion 32 (42) located in front of the first connecting portion 31 (41), a contacting portion 33 (43) extending forwardly from a front end of the second mounting portion 32 (42), a second connecting portion 34 (44) extending downwardly from a rear end of the first mounting portion 31 (41) and a solder tail 35 (45) extending rearwardly from a rear end of the second connecting portion 34 (44). Referring to FIG. 3, it should be noted that a distance between the first mounting portion 30 and the second mounting portion 32 of the first terminal 3 is larger than that of the second terminal 4. A distance between the first mounting portion 30 and the tail portion 35 of the first terminal 3 is smaller than that between that of the second terminal 4.

Figure 6:
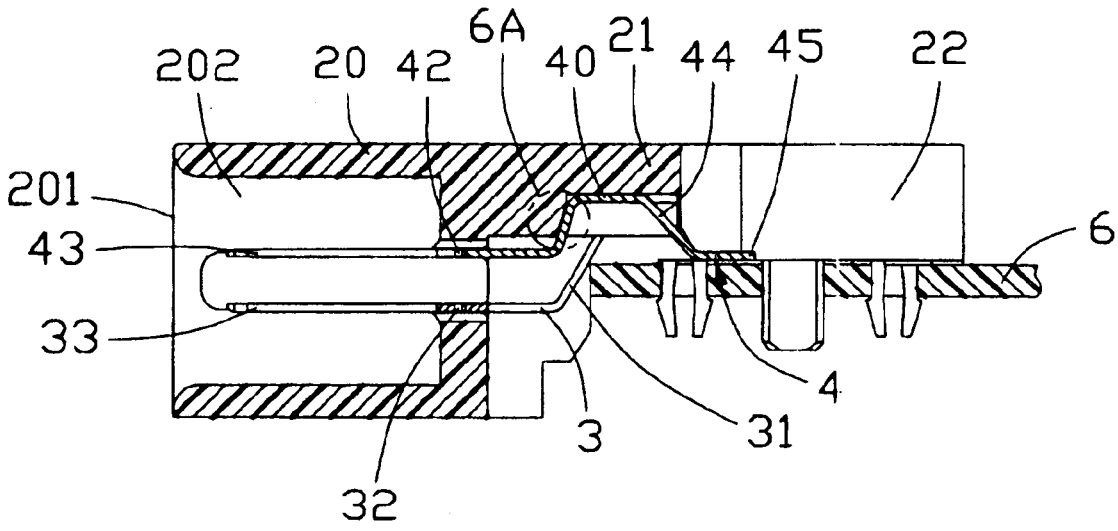
FIG. 6 is a cross-sectional view taken along line 6—6 of FIG. 4 wherein the electrical connector is assembled on a PCB.
Figure 6A:
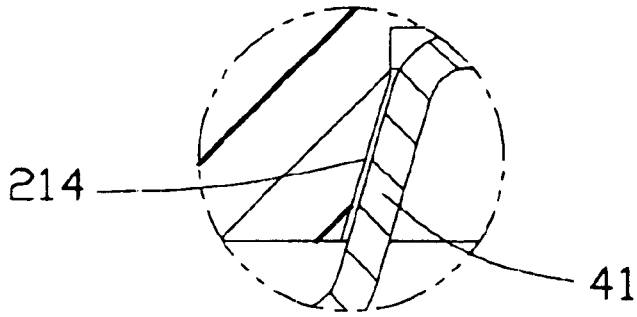
FIG. 6A is an enlarged view of a circled portion 6A of FIG. 6.
Figure 7:
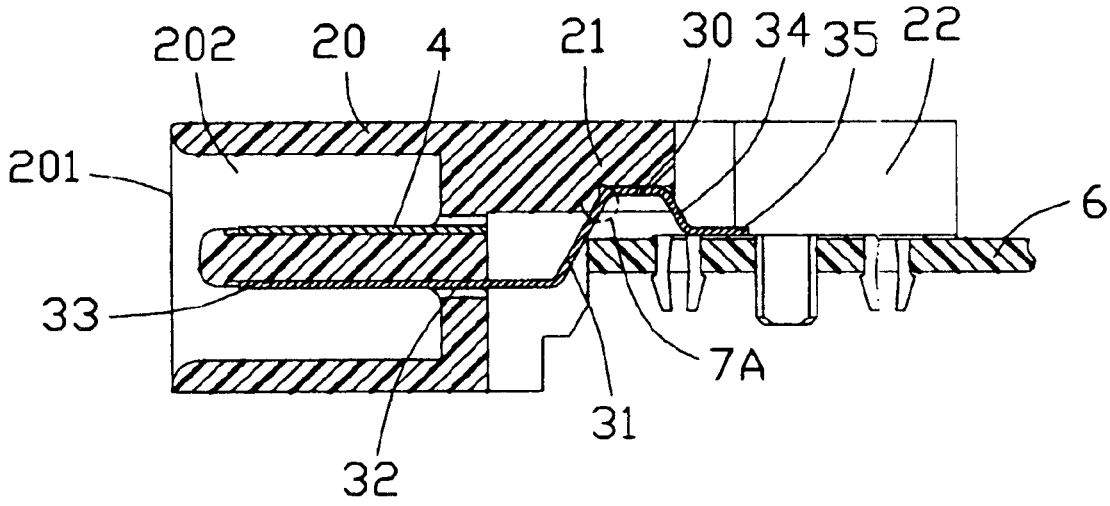
FIG. 7 is a cross-sectional view taken along line 7—7 of FIG. 4 wherein the electrical connector is assembled on a PCB.
Figure 7A:
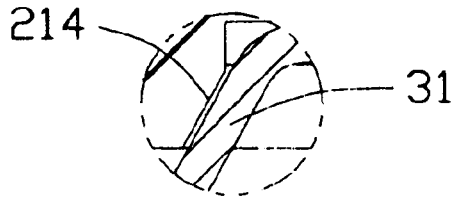
FIG. 7A is an enlarged view of a circled portion 7A of FIG. 7.

Referring to FIGS. 4–7A, in assembly, the first and second terminals 3, 4 are assembled to the insulative housing 2 with the tail portions 35, 45 extending rearwardly from the insulative housing 2 in a horizontal plane. Thus, the tail portions 35, 45 can be soldered to the PCB by surface mounting technology (SMT). The first mounting portions 30, 40 of the first and second terminals 3, 4 are received in corresponding T-shaped recesses 212, 213. The second mounting portions 32, 42 of the first and second terminals 3, 4 are received in corresponding passageways 203. In addition, the first connecting portions 31, 41 abut against corresponding slanted surfaces 214 (FIGS. 6A, 7A).

When the electrical connector 1 is mounted on the PCB 6, referring to FIGS. 6 and 7, the rear portion 21 is placed upon the PCB 6 with the posts 221 being received in corresponding holes of the PCB 6 for establishing a proper connection between the solder pads (not labeled) of the PCB 6 and the terminals 3, 4 of the electrical connector 1. The board locks 222 engage with corresponding receiving holes for securely retaining the electrical connector 1 on the PCB 6. The tail portions 35, 45 of the first and second terminals 3, 4 contact with the solder pads of the PCB 6, wherein the solder pads are arranged in a row; the retention force of the board locks 222 may cause a depressing force acting on the tail portions 35, 45 of the terminals 3, 4. The depressing force causes the terminals 3, 4 to have a tendency to be deformed; however, in the present invention, since the slanted surfaces 215 press against first connecting portion 31, 41 of the terminals 3, 4, the possible deformation of the terminals 3, 4 can be prevented.

In the present invention, because the first T-shaped recesses 212 and the second T-shaped recesses 213 are arranged in a staggered manner, a distance between two linearly adjacent recesses 212 (213) is larger than that of the prior art. Thus, the insulative housing 2 has a larger thickness between two linearly adjacent recesses 212 (213) than that of the prior art and thus the insulative housing 2 has more available material to engage with the first mounting portions 30 (40); thus, a possible breakage of the insulative housing 2 by the first mounting portions 30 (40) can be avoided. In addition, the second mounting portions 32, 42 and the first mounting portion 30, 40 engage with the insulative housing 2 so that the first and second terminals 3, 4 can be securely retained in the insulative housing 2 and the tail portions 35, 45 can be reliably kept at a common plane.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for connecting a mating plug connector and a printed circuit board (PCB) comprising:

an insulative housing including a mating surface adapted for mating with the plug connector, a mounting surface adapted for mounting on the PCB, a plurality of recesses at a rear end thereof, and a slant surface formed in a rear end of each of the recesses; and a plurality of terminals received in the insulative housing, each terminal comprising a first mounting portion, a first connecting portion extending from a front end of the first mounting portion, wherein the mounting surface is perpendicular to the mating surface, the first mounting portion are received in the recesses and the first connecting portions abut against corresponding slant surfaces.

2. The electrical connector as described in claim 1, wherein the recesses are T-shaped.

3. The electrical connector as described in claim 1, wherein the recesses are arranged in a staggered manner in a row.

4. The electrical connector as described in claim 1, wherein each of the terminals further comprises a second mounting portion extending forwardly from the first connecting portion, a contacting portion extending forwardly from a front end of the second mounting portion adapted for mating with the mating plug connector, a second connecting portion extending from a rear end of the first mounting portion and a tail portion extending rearwardly from a rear end of the seconding connecting portion adapted for soldering to the printed circuit board.

5. The electrical connector as described in claim 4, wherein the insulative housing defines a plurality of receiving passageways for receiving the second mounting portions.

6. An electrical connector comprising:

an insulative housing having a mating surface adapted for engaging with a mating connector, a receiving slot in the mating surface, upper and lower receiving passageways in communication with the receiving slot, and a row of staggered recesses;

a plurality of first and second terminals having first mounting portions arranged in a row, the first mounting portions of the first and second terminals being alternately fitted in the staggered recesses, second mounting portions arranged in two rows respectively fitted in the upper and lower receiving passageways, and tall portions extending rearwards end horizontally from the first mounting portions, arranged alternately in a row and adapted for soldering to a printed circuit board by surface mounting technology.

7. The electrical connector in accordance with claim 6, wherein the insulative housing forms a slant surface in each of the staggered recesses, each of the first and second contacts having a connecting portion between the fist and second mounting portions thereof, the connecting portion abutting against a corresponding slant surface.

8. An electrical connector assembly comprising:

an insulative housing including an elongated main body defining upper and lower rows of passageways;

upper and lower rows of contacts disposed in the corresponding passageways, respectively;

a rear portion extending rearwardly from an upper portion of a rear face of the main body;

a plurality of recesses disposed in the rear portion;

a printed circuit board located under the rear portion, around a mid-level relative to the housing and behind the rear face of the main body with a gap therebetween in a front-to-back direction;

the contacts of the lower row defining a trough-like tail portion including a horizontal mounting portion engageably received in the corresponding recess and vertically spaced from the printed circuit board, a first connecting portion obliquely downwardly extending from an inner end of said horizontal mounting portion, and a second connecting portion downwardly from an outer end of the horizontal mounting portion with an distal end soldered on the printed circuit board; wherein said first connecting portion extends obliquely downwardly beyond the printed circuit board and cross the gap, and terminates at a position horizontally aligned with the corresponding passageway of the lower row.

9. The assembly as described in claim 8, wherein an upper portion of said first connecting portion abuts against a slanted surface in the corresponding recess.

10. The assembly as described in claim 8, wherein said horizontal mounting portion provides retention in the corresponding recess.

* * * * *